US009459572B2

(12) United States Patent
Akiyama et al.

(10) Patent No.: US 9,459,572 B2
(45) Date of Patent: Oct. 4, 2016

(54) FIXING MEMBER MANUFACTURING METHOD AND FIXING MEMBER MANUFACTURING APPARATUS

(71) Applicant: CANON KABUSHIKI KAISHA, Tokyo (JP)

(72) Inventors: Naoki Akiyama, Toride (JP); Hiroto Sugimoto, Toride (JP); Yasuhiro Miyahara, Tokyo (JP); Nobuyuki Kume, Miura-gun (JP); Yoshiaki Yoshida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 36 days.

(21) Appl. No.: 14/063,229

(22) Filed: Oct. 25, 2013

(65) Prior Publication Data

US 2014/0116603 A1 May 1, 2014

(30) Foreign Application Priority Data

Oct. 29, 2012 (JP) ..... 2012-237943

(51) Int. Cl.
*G03G 15/20* (2006.01)

(52) U.S. Cl.
CPC ..... *G03G 15/2057* (2013.01); *G03G 15/2017* (2013.01); *G03G 2215/2032* (2013.01)

(58) Field of Classification Search
CPC ..... G03G 15/2017; G03G 2215/2032; G03G 15/2057; B29C 51/16; B29C 66/43; B29C 65/18; B65C 3/16; B65C 3/12; B65C 9/1819
USPC ..... 156/165, 423, 160, 212, 215, 218, 213, 156/187, 188, 293, 294, 229, 221, 226, 156/227; 399/328, 330
See application file for complete search history.

(56) References Cited

U.S. PATENT DOCUMENTS 7,651,749 B2 1/2010 Nanbu et al.
9,180,628 B2 11/2015 Lengsfeld et al.

(Continued)

FOREIGN PATENT DOCUMENTS

CN 1489720 A 4/2004
CN 101896329 A 11/2010
JP 2002-036360 A 2/2002

(Continued)

OTHER PUBLICATIONS

Kishino Kazuo, Method for manufacturing fixing member Jul. 1, 2010, Japan Patent Office, all pages.*

(Continued)

*Primary Examiner* — Jacob T Minskey
*Assistant Examiner* — Vishal I Patel
(74) *Attorney, Agent, or Firm* — Fitzpatrick, Cella, Harper & Scinto

(57) ABSTRACT

A fixing member manufacturing method includes: a step of holding a longitudinal end of a resin tube by a first holding tool; a step of holding another longitudinal end of the resin tube by a second holding tool; a step of decreasing a distance between the first and second holding tools each holding the resin tube, by a predetermined amount; a step of expanding, after the decreasing step, the resin tube in a radial direction; and a step of externally fitting the resin tube, expanded in the radial direction, around an elastic material coated with an adhesive.

10 Claims, 8 Drawing Sheets

(56) References Cited

U.S. PATENT DOCUMENTS

| | | | |
|---|---|---|---|
| 2010/0276069 | A1 | 11/2010 | Lengsfeld et al. |
| 2013/0202333 | A1 | 8/2013 | Sugimoto |

FOREIGN PATENT DOCUMENTS

| | | | |
|---|---|---|---|
| JP | 2004-276290 | A | 10/2004 |
| JP | 2010-143118 | A | 7/2010 |

OTHER PUBLICATIONS

Kon Shuji, Manufacture of tube coated roller Mar. 2, 1999, Espacenet, all pages.*
Machine translation of JP 2002036360A (Date: Feb. 5, 2002).*
U.S. Appl. No. 14/063,234, filed Oct. 25, 2013, Miyahara et al.
U.S. Appl. No. 14/064,328, filed Oct. 28, 2013, Miyahara et al.
U.S. Appl. No. 14/064,335, filed Oct. 28, 2013, Miyahara et al.
U.S. Appl. No. 14/060,936, filed Oct. 23, 2013, Akiyama et al.
U.S. Appl. No. 14/063,224, filed Oct. 25, 2013, Akiyama et al.
U.S. Appl. No. 14/158,098, filed Jan. 17, 2014, Miura et al.
First Office Action in Chinese Application No. 201310519852.7 (issued Nov. 2, 2015).

* cited by examiner (a)

(b)

FIXING MEMBER MANUFACTURING METHOD AND FIXING MEMBER MANUFACTURING APPARATUS

FIELD OF THE INVENTION AND RELATED ART

The present invention relates to a fixing member manufacturing method and a fixing member manufacturing apparatus.

As a fixing member used in a fixing device to be conventionally mounted in an image forming apparatus of an electrophotographic type, a belt-shaped fixing member and a roller-shaped fixing member have been known.

As these fixing members, a fixing member prepared by forming an elastic layer (elastic material) of a heat-resistant rubber or the like on a substrate (base material) and then by providing, on a surface of the elastic layer, a resin layer (such as a fluorine-containing resin layer) having an excellent parting property with respect to a toner has been known.

As such a fixing member, Japanese Laid-Open Patent (JP-A) 2004-276290 discloses that a substrate is inserted into a fluorine-containing resin tube enlarged in diameter and then the fluorine-containing resin tube is fixed by an adhesive with which an outer peripheral surface of the substrate is coated.

Further, JP-A 2004-276290 discloses that the fluorine-containing resin tube formed by extrusion molding is used. Further, JP-A 2004-276290 discloses that as a thickness of the fluorine-containing resin tube, 50 μm or less is preferred in view of difficulty of deformation of the tube, and 20 μm or more is preferred in consideration of a molding property.

Incidentally, in order to reduce an energy consumption amount during fixing, further improvement in heat conduction efficiency of the fixing member has been required. For that reason, also with respect to the fluorine-containing resin tube, use of a thin fluorine-containing resin tube has been required.

Here, a thin seamless fluorine-containing resin tube of about 10-50 μm in thickness is capable of being formed by the extrusion molding. However, there is a fear that a fixing member manufactured by coating a cylindrical elastic layer with the thin fluorine-containing resin tube formed by the extrusion molding and then by fixing the elastic layer and the tube with an adhesive generates cracks, with respect to a longitudinal direction of the fluorine-containing resin tube, with an increase in the number of sheets subjected to the fixing.

With respect to this problem that the cracks or creases are generated, in JP-A 2010-143118, the reason why the cracks are generated is presumed that in the thin fluorine-containing resin tube obtained by the extrusion molding, fluorine-containing resin molecules are oriented (aligned) in the longitudinal direction of the tube to a high degree. Therefore, reduction in degree of orientation of the fluorine-containing resin molecules in the longitudinal direction of the fluorine-containing resin tube is attempted by annealing (treatment) of the fluorine-containing resin tube.

However, the degree of orientation of the fluorine-containing resin molecules in the longitudinal direction of the fluorine-containing resin tube correlates with a degree of crystallinity of the fluorine-containing resin tube. The thin fluorine-containing resin tube has a tendency that both of the degree of orientation and degree of crystallinity of the fluorine-containing resin (molecules) are high. The high degree of crystallinity itself is an advantageous characteristic since the generation of the creases on the surface of the fluorine-containing resin tube can be suppressed in the fixing member in which the fluorine-containing resin tube is to be repeatedly flexed by following the elastic layer.

For that reason, as a method of lowering the degree of orientation while minimizing a lowering in degree of crystallinity of the thin seamless fluorine-containing resin tube obtained by the extrusion molding, JP-A 2010-143118 proposes the following method.

That is, the fluorine-containing resin tube is formed by the extrusion molding so that the fluorine-containing resin tube has an inner diameter smaller than an outer diameter of the cylindrical elastic layer. The fluorine-containing resin tube is increased in diameter (with respect to a radial direction) and then the cylindrical elastic layer is coated with the fluorine-containing resin tube, and thereafter a diameter-increased state of the fluorine-containing resin tube is maintained. Concurrently, the fluorine-containing resin tube is elongated in the longitudinal direction, and in that state, the fluorine-containing resin tube is heated on the elastic layer. As a result, even in a long-term use, creases or cracks are not readily generated on the surface of the fluorine-containing resin tube, so that the fluorine-containing resin tube is capable of stably achieving a good fixing performance.

However, the fluorine-containing resin tube has manufacturing variation, and therefore when the fluorine-containing resin tube having a small diameter was increased in diameter, non-negligible plastic deformation was generated in some cases. At a portion where the plastic deformation is generated, even when heating in a subsequent step is made, there is a fear that flex resistance (elasticity) and crack resistance are lowered due to a decrease in thickness of the fluorine-containing resin tube compared with a portion where the plastic deformation is not generated and due to residual stress.

SUMMARY OF THE INVENTION

A principal object of the present invention is to provide a fixing member manufacturing method and a fixing member manufacturing apparatus which are used for manufacturing a fixing member (member for fixing) capable of achieving a good fixing performance for a long term.

According to an aspect of the present invention, there is provided a fixing member manufacturing method comprising: a step of holding a longitudinal end of a resin tube by a first holding tool; a step of holding another longitudinal end of the resin tube by a second holding tool; a step of decreasing a distance between the first and second holding tools each holding the resin tube, by a predetermined amount; a step of expanding, after the decreasing step, the resin tube in a radial direction; and a step of externally fitting the resin tube, expanded in the radial direction, around an elastic material coated with an adhesive.

According to another aspect of the present invention, there is provided a fixing member manufacturing apparatus comprising: a hollow cylindrical member in which a resin tube is inserted; a first holding tool configured to hold a longitudinal end of a resin tube inserted in the cylindrical member; a second holding tool configured to hold another longitudinal end of the resin tube inserted in the cylindrical member; a driving mechanism configured to decrease a distance between the first and second holding tools each holding the resin tube, by a predetermined amount; an expanding mechanism configured to expand the resin tube toward an inner surface of the cylindrical member after the distance between the first and second holding tools is decreased; and an externally fitting mechanism configured to externally fit the resin tube, expanded by the expanding mechanism, around an elastic material coated with an adhesive.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a) to (k) of FIG. 1 are schematic views for illustrating a PFA tube coating method in Embodiment 1.

Parts (a) and (b) of FIG. 2 are schematic views for illustrating a structure of a fixing belt (or a pressing belt).

DESCRIPTION OF THE PREFERRED EMBODIMENTS

The present invention will be described specifically based on embodiments. Incidentally, although these embodiments are examples of embodiments to which the present invention, but the present invention is not limited thereto, and various modifications can be made within a range of the concept of the present invention.

Embodiment 1

(1) Image Forming Apparatus

Figure 3:
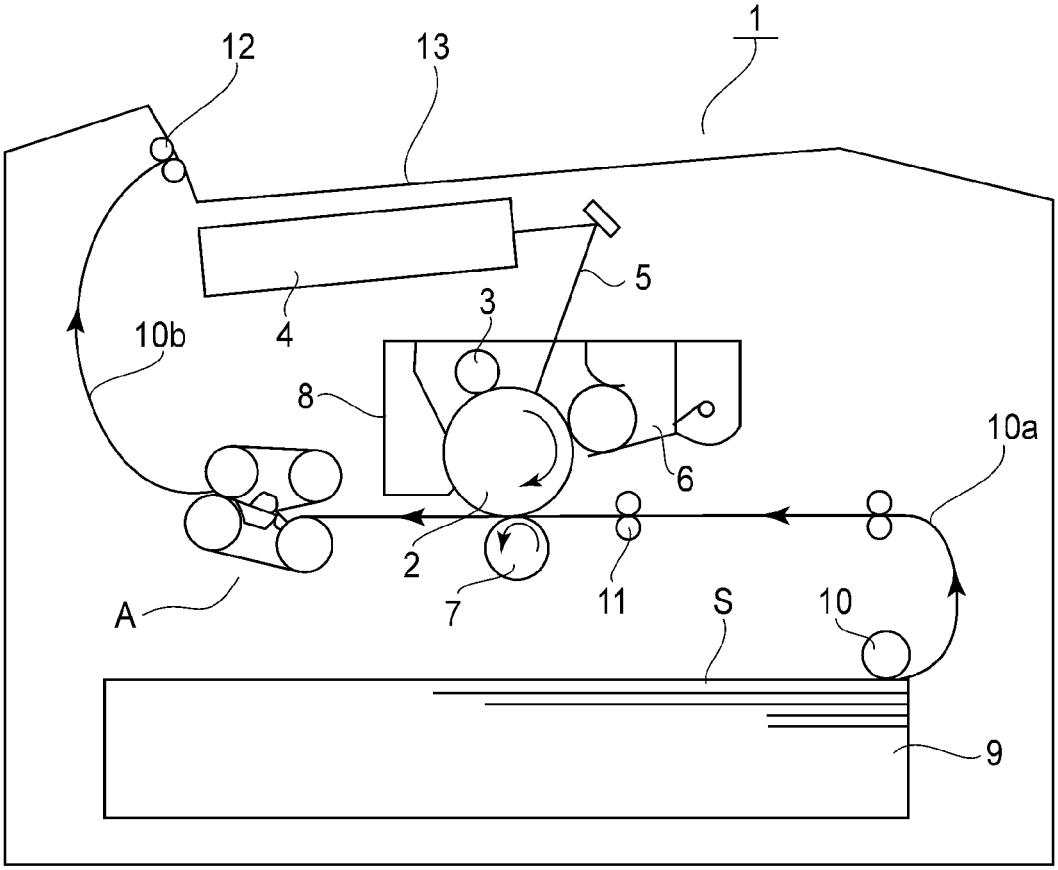
FIG. 3 is a schematic view for illustrating a structure of an image forming apparatus as an example.

FIG. 3 is a schematic illustration showing a general structure of an image forming apparatus used in this embodiment. An image forming apparatus 1 is a laser printer of an electrophotographic type and includes a photosensitive drum 2 as an image bearing member for bearing a latent image. The photosensitive drum 2 is rotationally driven in the clockwise direction at a predetermined peripheral speed, so that an outer surface of the photosensitive drum 2 is electrically charged uniformly to a predetermined polarity and a predetermined potential. The uniformed charged surface of the photosensitive drum 2 is exposed to laser light 5 based on image information by a laser scanner (optical device) 4. As a result, on the surface of the photosensitive drum 2, an electrostatic latent image corresponding to the image information of the laser light is formed.

The electrostatic latent image is developed as a toner image by a developing device 6. The toner image is successively transferred onto a recording material (sheet) S, introduced into a transfer portion as a contact portion between the photosensitive drum 2 and a transfer roller 7, at the transfer portion.

Sheets of the recording material S are stacked and accommodated in a sheet feeding cassette 9 provided at a lower portion of the image forming apparatus. At predetermined sheet feeding timing, when a sheet feeding roller 10 is driven, the sheets of the recording material S in the sheet feeding cassette 9 are separated and fed one by one, and then the separated and fed recording material S passes through a conveying passage 10*a* to reach a registration roller pair 11. The registration roller pair 11 receives a leading edge portion of the recording material S to rectify oblique movement of the recording material S. The recording material S is sent to the transfer portion in synchronism with the toner image on the photosensitive drum 2 so that timing when a leading end portion of the toner image on the photosensitive drum 2 reaches the transfer portion coincides with timing when also the leading edge portion of the recording material S just reaches the transfer portion.

The recording material S passing through the transfer portion is separated from the surface of the photosensitive drum 2, and then is conveyed into an image fixing device A. By the fixing device A, the unfixed toner image on the recording material S is fixed as a fixed image on the recording material surface under application of heat and pressure. Then, the recording material S passes through a conveying passage 10*b* and then is discharged and placed on a discharge tray 13, by a discharging roller pair 12, provided at an upper portion of the image forming apparatus. Further, the surface of the photosensitive drum 2 after the recording material separation is cleaned by removing a residual deposited matter such as a transfer residual toner by a cleaning device 9, thus being repetitively subjected to image formation.

(2) Fixing Device A

Figure 4:
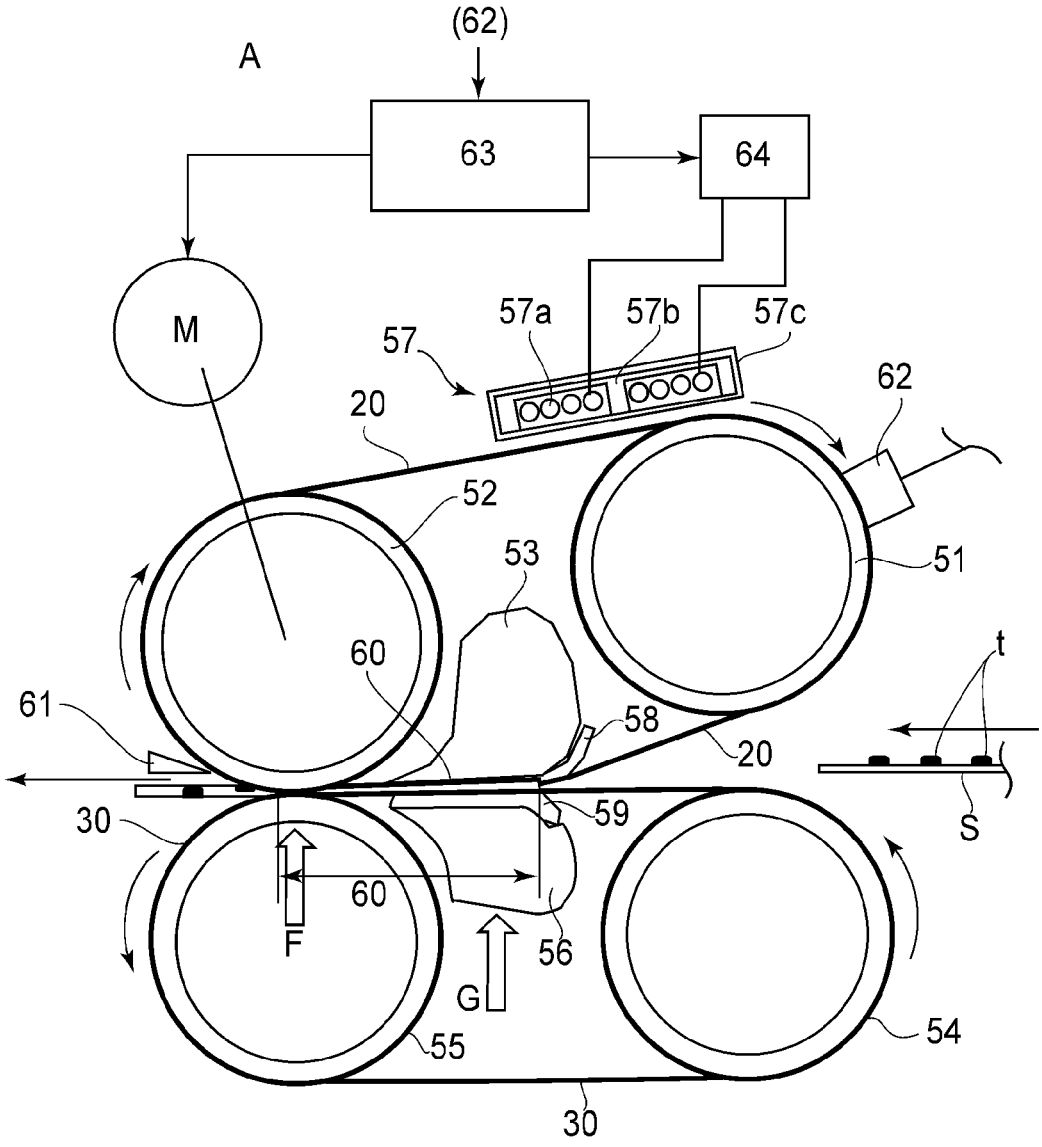
FIG. 4 is a schematic view for illustrating a fixing device in Embodiment 1.

FIG. 4 is a schematic illustration showing a general structure of the image hating fixing device A. The fixing device A is of a twin belt type and of an electromagnetic induction heating type.

Here, with respect to the fixing device A and members constituting the fixing device A, a longitudinal direction refers to a direction parallel to a direction perpendicular to a recording material conveyance direction in a plane of a recording material conveying passage. With respect to the fixing device, a front (side or surface) refers to a side or surface in a recording material introducing side. Left and right refer to left and right as seen from the front side of the fixing device. A width of the belt refers to a dimension of the belt with respect to the direction perpendicular to the recording material conveyance direction, i.e., the dimension of the belt with respect to the longitudinal direction. A width of the recording material refers to a dimension of the recording material with respect to the direction perpendicular to the recording material conveyance direction in a plane of the recording material. Further, upstream and downstream refer to upstream and downstream with respect to the recording material conveyance direction.

The fixing device A includes a fixing belt (heating member) 20 and a pressing belt (pressing member) 30 between which a nip where the recording material is heated and pressed which being nipped and conveyed is to be formed. In this embodiment, both of the fixing belt 20 and the pressing belt 30 are a flexible endless belt.

A structure of the fixing belt 20 will be specifically described later in (3). The fixing belt 20 is extended and stretched around a tension roller 51 and a fixing roller 52 which are provided, as a belt stretching member, in parallel to each other with a spacing, and a downward fixing pad 53 which is provided, as a first photosensitive drum, between the rollers 51 and 52. Each of the tension roller 51 and the fixing roller 52 is shaft-supported rotatably between left and right side plates of a fixing device casing (not shown). The fixing pad 53 is supported and disposed between the left and right side plates of the fixing device casing.

The tension roller 51 is an iron-made hollow roller of 20 mm in outer diameter, 18 mm in inner diameter and 1 mm in thickness, and provides tension to the fixing belt 20.

The fixing roller 52 is an elastic roller, having a high sliding property, which is prepared by forming a silicone rubber elastic layer, as an elastic layer, on an iron alloy-made hollow core metal of 20 mm in outer diameter, 18 mm in inner diameter and 1 mm in thickness. The fixing roller 52 is used as a driving roller into which a driving force is inputted from a driving source (motor) M via an unshown driving gear train, thus being rotationally driven in the clockwise direction of an arrow at a predetermined speed.

By providing the fixing roller 52 with the elastic layer as described above, it is possible to satisfactorily transmit the driving force, inputted into the fixing roller 52, to the fixing belt 20, and at the same time, it is possible to form a fixing nip for ensuring a separating property of the recording material S from the fixing belt 20. Hardness of the silicone rubber is 15 degrees in terms of JIS-A hardness. The silicone rubber elastic layer is also effective in shortening a warming-up time since an amount of heat conduction to the inside is also decreased.

The pressing belt 30 is prepared, in this embodiment, by providing, on a base layer of electroformed nickel, a 30 μm-thick tube of PFA, which is a fluorine-containing resin material, as a surface parting layer. In FIG. 4, the pressing belt 30 is located below the fixing belt 20 and is disposed in the following manner. That is, the pressing belt 30 is extended and stretched around a tension roller 54 and a pressing roller 55 which are provided, as a belt stretching member, in parallel to each other with a spacing, and a upward fixing belt 56 which is provided, as a second photosensitive drum, between the rollers 54 and 55. Each of the tension roller 54 and the pressing roller 55 is shaft-supported rotatably between left and right side plates of a fixing device casing (not shown).

The tension roller 54 is prepared by forming a silicone sponge layer for decreasing a degree of heat conduction from the pressing belt 30 by decreasing heat conductivity, on an iron alloy-made hollow core metal of 20 mm in outer diameter, 16 mm in inner diameter and 2 mm in thickness. The tension roller 54 provides tension to the pressing belt 30. The pressing roller 55 is an iron alloy-made hollow rigid roller, having a low sliding property, of 20 mm in outer diameter, 16 mm in inner diameter and 2 mm in thickness. The pressing pad 56 is supported and disposed between the left and right side plates of the fixing device casing.

Further, in order to form a fixing nip 60 as an image heating portion between the fixing belt 20 and the pressing belt 30, the pressing roller 55 is pressed at each of left and right end portions of a rotation shaft thereof by a pressing mechanism (not shown) toward the fixing roller 52 in an arrow F direction at a predetermined pressure.

Further, in order to obtain a wide fixing nip 60 without upsizing the fixing device, the pressing pad 56 is employed. That is, the fixing belt 20 is pressed toward the pressing belt 30 by the fixing belt 53, and at the same time, the pressing belt 30 is pressed toward the fixing belt 20 by the pressing pad 56. The pressing pad 56 is pressed toward the fixing pad 53 in an arrow G direction at predetermined pressure by a pressing mechanism (not shown). The fixing belt 20 and the pressing belt 30 are press-contacted to each other between the fixing pad 53 and the pressing pad 56, so that the wide fixing nip 60 is formed with respect to the recording material conveyance direction.

The fixing pad 53 includes a pad substrate and a slidable sheet (low-friction sheet) 58 contacted to the fixing belt inner surface. The pressing pad 56 includes a pad substrate and a slidable sheet 59 contacted to the pressing belt inner surface. This is because in the case where the belt base layer is formed of metal, there is a problem that an amount of abrasion (wearing) of a portion of the pad sliding on the inner peripheral surface of the belt is large. By interposing each of the slidable sheets 58 and 59 between the belt and the pad substrate, the abrasion of the pad can be prevented and it is also possible to reduce sliding resistance, and therefore it is possible to ensure a good belt travelling property and a good belt durability.

As a heating means for the fixing belt 20, a heating source (induction heating member, exciting coil) of an electromagnetic induction heating type having high energy efficiency is employed. An induction heating member 57 as the heating source is provided, with a slight gap, opposed to an outer surface of an upper-side belt portion of the fixing belt 20.

The induction heating member 57 is constituted by an induction coil 57*a*, an exciting core 57*b* and a coil holder 57*c* for holding the coil and the core. The induction coil 57*a* is wound in an elongated circular and flat shape by using Litz wire and is provided in the exciting core 57*b* formed in a downward E shape projected to a central portion and end portions of the induction coil 57*a*. The exciting core is formed by using a material, having high magnetic permeability and low residual magnetic flux density, such as ferrite or permalloy, and therefore loss of the induction coil 57*a* and the exciting core 57*b* can be suppressed, so that it is possible to efficiently heat the fixing belt 20.

A fixing operation is as follows. A control circuit portion 63 drives a motor M at least during execution of image formation. Further, a high-frequency current is carried from an exciting circuit 64 through the induction coil 57*a* of the induction heating member 57.

By driving the motor M, the fixing roller 52 is rotationally driven. As a result, the fixing belt 20 is rotationally driven in the same direction as the fixing roller 52. A peripheral speed of the fixing belt 20 is slightly slower than a conveyance speed of the recording material (sheet) S conveyed from the image forming portion in order to form a loop on the recording material S in a recording material entrance side of the fixing nip 60. In this embodiment, the peripheral speed of the fixing belt 20 is 300 mm/sec, so that a full-color image can be formed on an A4-sized sheet at a rate of 70 sheets/min.

The pressing belt 30 is rotated by the rotation of the fixing belt 20 by a frictional force with the fixing belt 20 at the fixing nip 60. Here, by employing a constitution in which a downstreammost portion of the fixing nip 60 is conveyed by sandwiching the fixing belt 20 and the pressing belt 30 between the roller pair 52 and 55, slip of the belt can be prevented. The downstreammost portion of the fixing nip 60 is a portion where a pressure distribution (with respect to the recording material conveyance direction) at the fixing nip 40 is maximum.

On the other hand, by passing the high-frequency current from the exciting circuit 54 through the induction coil 57*a* of the induction heating member 57, the metal layer of the fixing belt 20 generates heat by induction heating, so that the fixing belt 20 is heated. A surface temperature of the fixing belt 20 is detected by a temperature detecting element 62 such as a thermistor. A signal relating to the temperature of the fixing belt 20 detected by the temperature detecting element 62 is inputted into the control circuit portion 63. The control circuit portion 63 controls electric power supplied from the exciting circuit 64 to the induction coil 57*a* so that temperature information inputted from the temperature detecting element 62 is maintained at a predetermined fixing temperature, thus controlling the temperature of the belt 20 at the predetermined fixing temperature.

In a state in which the fixing belt 20 is rotationally driven and is increased up to the predetermined fixing temperature to be temperature-controlled, into the fixing nip 60 between the fixing belt 20 and the pressing belt 30, the recording material S on which the unfixed toner image t is carried is conveyed. The recording material S is introduced with the surface, toward the fixing belt 20, where the unfixed toner image t is carried. Then, the recording material S is nipped and conveyed through the fixing nip 60 while intimately contacting the outer peripheral surface of the fixing belt 20 at the unfixed toner image carrying surface thereof, so that the recording material S is supplied with heat and pressure from the fixing belt 20, and thus the unfixed toner image t is fixed on the surface of the recording material S.

Further, the fixing roller 32 in the fixing belt 20 in the elastic roller having the rubber layer, and the pressing roller 55 in the pressing belt 30 is the iron alloy-made rigid roller, and therefore a degree of deformation of the fixing roller 52 is large at an exit of the fixing nip 40 between the fixing belt 20 and the pressing belt 30. As a result, also the fixing belt 20 is larger deformed, so that the recording material S on which the fixed toner image is carried is curvature-separated from the fixing belt 20 by its own resilience. At the fixing nip exit, a separation assisting claw member 61 is provided.

(3) Fixing Belt 20

Figure 2:
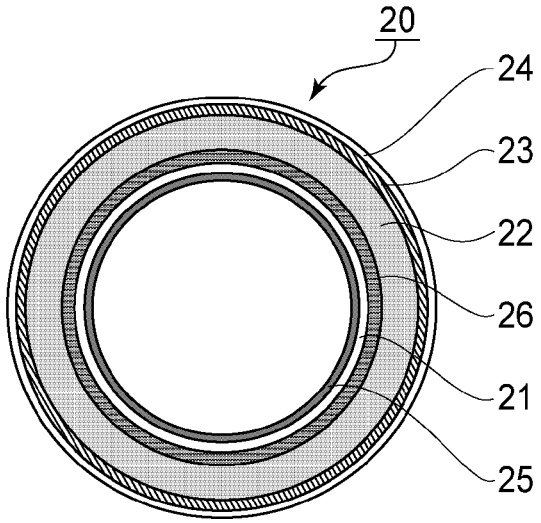
Figure 2:
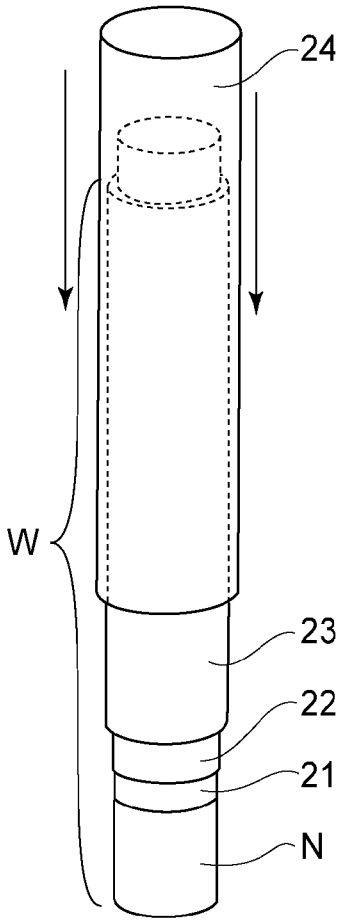

Part (a) of FIG. 2 is schematic sectional view showing a layer structure of the fixing belt 20 as the fixing member in this embodiment, and (b) of FIG. 2 is a schematic view for illustrating a manner of lamination of constituent layers. The fixing belt 20 includes a base material (cylindrical substrate) 21, an inner surface slidable layer 25 provided on an inner peripheral surface of the base material 21, a primer layer (adhesive layer) 26 with which an outer peripheral surface of the base material 21 is coated, an elastic (cylindrical elastic material) 22 provided on the primer layer 26, and a surface layer (toner parting layer 24). The resin tube, i.e., the fluorine-containing resin tube 24 is fixed by an adhesive layer 23 with which the peripheral surface of the elastic layer 22 is coated.

The fixing belt 20 in this embodiment is a laminated composite layer member having the above-mentioned 6 layers, and is a thin fixing member having flexibility as a whole and low thermal capacity. Further, the fixing belt 20 holds a substantially cylindrical shape in a free state thereof. The respective layers will be specifically described below.

(3-1) Base Material 21

In this embodiment, in order to heat the base material 21 by the above-described induction heating member 57, the base material 21 for the fixing belt 20 is formed in a metal layer of SUS alloy, nickel, iron, magnetic stainless steel, cobalt-nickel alloy, or the like. In this embodiment, an electroformed nickel belt of 55 mm in inner diameter and 65 μm in thickness is used as the base material 21.

The thickness of the base material 21 may preferably be 1-300 μm. When the thickness of the base material 21 is smaller than 1 μm, rigidity is low, and therefore it becomes difficult to withstand a durability test of a large number of sheets. Further, when the thickness of the base material 21 exceeds 300 μm, the rigidity becomes excessively high, and flexing resistance is lowered, so that use of the resultant belt as the rotatable belt member is not practical. In a preferred embodiment, the thickness of the base material 21 is ideal that it is 20 μm to 100 μm.

(3-2) Inner Surface Slidable Layer 25

As a material for the inner surface slidable layer 25, a resin material, such as polyimide resin, having high durability and high heat resistance is suitable. In this embodiment, a polyimide precursor solution obtained by reaction, in an organic polar solvent, of aromatic tetracarboxylic dianhydride or its derivative with aromatic diamine in a substantially equimolecular amount was applied onto the inner surface of the base material 21. Thereafter, the solution was dried and heated to form a polyimide resin layer by dewatering cyclization reaction, thus preparing the inner surface slidable layer 25.

(3-3) Elastic Layer 22

Over the outer peripheral surface of the base material 21, the elastic layer 22 is provided via the primer layer 26. As a material for the elastic layer 22, a known elastic material can be used. For example, silicone rubber, fluorine-containing rubber and the like can be used.

The thickness of the elastic layer 22 may preferably be 100 μm or more in order to prevent uneven glossiness caused due to unevenness of the recording material S or failure that the heating surface of the fixing belt cannot follow the unevenness in the case where an image is printed.

When the thickness of the elastic layer 22 is less than 100 μm, a function of the elastic layer 22 as an elastic member cannot be readily achieved, and therefore a pressure distribution during fixing becomes non-uniform, so that particularly during full-color image fixing, an unfixed toner (image) of a secondary color cannot be sufficiently heat-fixed to cause non-uniformity of gloss on a fixed image. Further, due to insufficient melting, a color-mixing property of the toner is lowered, so that a high-definition full-color image cannot be obtained, thus being unpreferable. In this embodiment, silicone rubber is used as the material for the elastic layer 22, and the elastic layer 22 is 6 degrees in JIS-A hardness, 0.8 W/mk in thermal conductivity and 450 μm in thickness.

A coating method of the elastic layer 22 will be described with reference to FIG. 5.

Figure 5:
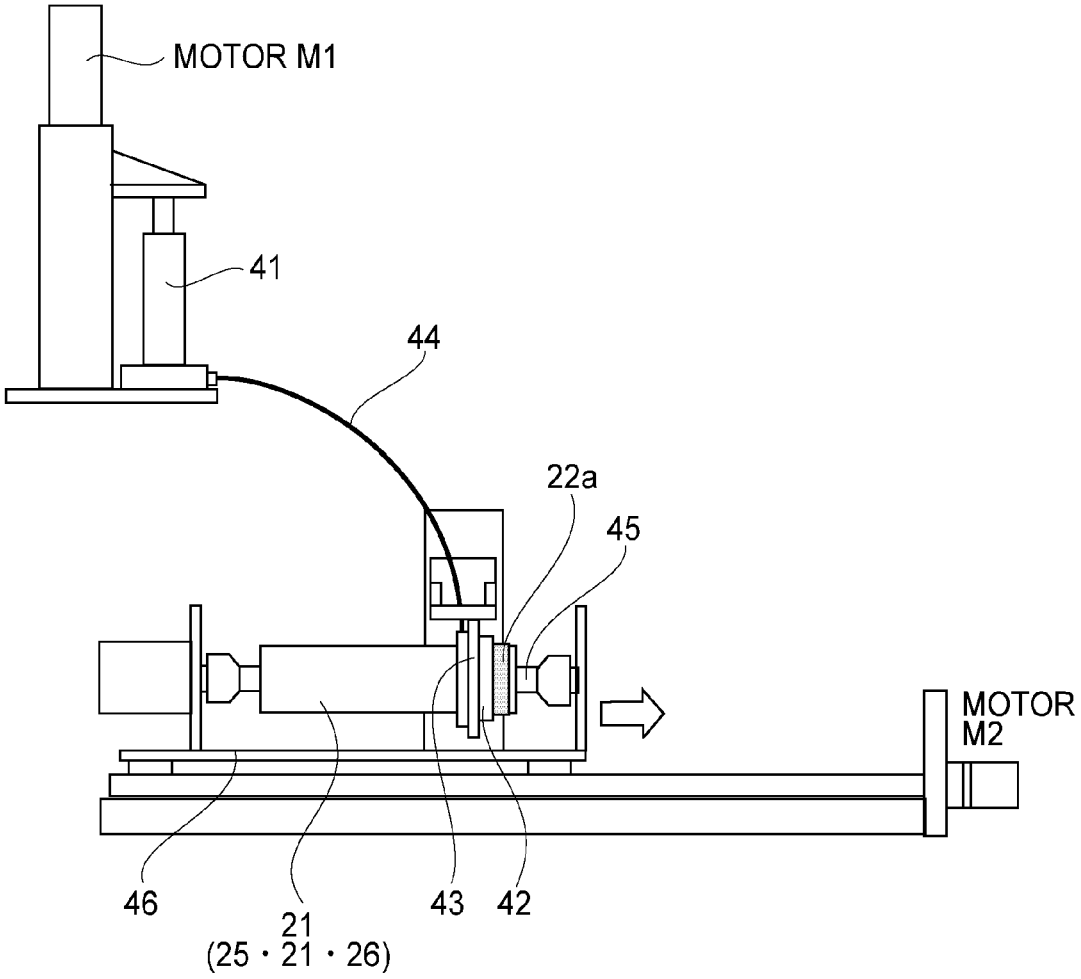
FIG. 5 is a schematic view for illustrating an elastic layer forming method.

FIG. 5 shows an example of a step of forming the silicone rubber layer as the elastic layer 22, and is a schematic view for illustrating a method using a so-called ring-coating (method).

In this embodiment, the addition curing type silicone rubber composition in which the addition curing type silicone rubber and the filler are mixed is charged into a cylinder pump 41. Then, the composition is pressured-fed from the cylindrical pump 41 to a ring-shaped coating head, so that the addition curing type silicone rubber composition is applied onto the peripheral surface of the cylindrical substrate 21 (25, 21, 26) from a coating liquid supply nozzle (not shown) provided inside the ring-shaped coating head 42. The peripheral surface of the cylindrical substrate 21 has been subjected to primer treatment (adhesive coating) in advance by a known method.

The coating head 42 is held by a fixed coating head holding portion 43. The cylinder pump 41 is driven by a motor M1 to press-feed the addition curing type silicone rubber composition to the coating head 42 via a tube 44.

The cylindrical substrate 21 (exactly the structure consisting of the layers 25, 21, 26, 22, 23 and 24) is externally fitted and held around a cylindrical core metal held by a core metal holding tool (fixture) 45. The core metal holding tool 45 is held by a coating table 46 so that an axis thereof is horizontal, and thus is horizontally movable. The ring-shaped coating head 42 is coaxially and externally fitted around the cylindrical substrate 20*b*. The coating table 46 is reciprocated in a horizontal axis direction of the core metal holding tool 45 at a predetermined speed by a motor M2.

Simultaneously with the coating by the coating head 42, by moving (reciprocating) the cylindrical substrate 21 in a right direction in FIG. 5, a coated film (layer) 22*a* of the addition curing type silicone rubber composition can be cylindrically formed on the peripheral surface of the cylindrical substrate 21.

A thickness of the coated film 22*a* can be controlled by a clearance between the coating liquid supply nozzle and the cylindrical substrate 21, a supplying (feeding) speed of the silicone rubber composition, a moving speed of the cylindrical substrate 21, and the like.

The addition curing type silicone rubber composition layer 22*b* formed on primer layer 26 (formed on the cylindrical substrate 21) is heated for a certain time by a heating means such as electric furnace to cause crosslinking reaction, so that the silicone rubber elastic layer 22 can be formed. In this embodiment, the silicone rubber composition layer 22*a* was heated at 200° C. for 30 minutes in the electric furnace.

(3-4) Adhesive Layer 23

The adhesive layer 23 for fixing the fluorine-containing resin tube as the surface layer 24 over the cured silicone rubber layer as the elastic layer 22 is uniformly applied in a thickness of 1-10 μm onto the surface of the elastic layer 20*d* (an adhesive coat step in which the outer peripheral surface of the cylindrical elastic layer is coated with the adhesive). In this embodiment, the adhesive 23 is constituted by a cured material of an addition curing type silicone rubber adhesive. The addition curing type silicone rubber adhesive 23 contains an addition curing type silicone rubber in which a self-adhesive component is mixed.

Specifically, the addition curing type silicone rubber adhesive 23 contains organopolysiloxane having unsaturated hydrocarbon group represented by vinyl group, hydrogen organopolysiloxane, and a platinum compound as a crosslinking catalyst. The adhesive 20*e* is cured (hardened) by addition reaction. As such an adhesive 20*e*, a known adhesive can be used.

In this embodiment, the addition layer was uniformly applied in a thickness of about 5 μm.

(3-5) Fluorine-Containing Resin Tube 24

As the surface layer (toner parting layer) of the fixing member, from the viewpoints of a molding property and a toner parting property, a fluorine-containing resin tube 24 formed by extrusion molding is used.

As the fluorine-containing resin material, a tetrafluoroethylene/perfluoroalkylvinyl ether copolymer (PFA) excellent in heat resistance is suitably used (PFA tube).

The PFA tube used is formed by the extrusion molding. A type of copolymerization of a starting material for PFA is not limited particularly but may include, e.g., random copolymerization, block copolymerization, graft copolymerization, and the like.

Further, a content molar ratio between tetrafluoroethylene (TFE) and perfluoroalkylvinyl ether (PAVE) which are the starting material for PFA is not limited particularly. For example, the content molar ratio of TFE/PAVE may suitably be 94/6 to 99/1.

As other fluorine-containing resin materials, it is possible to use tetrafluoroethylene/hexafluoropropylene copolymer (FEP), polytetrafluoroethylene (PTFE), ethylene/tetrafluoroethylene copolymer (ETFE), polychlorotrifluoroethylene (PCTFE), ethylene/chlorotrifluoroethylene copolymer (ECTFE), polyvinylidene fluoride (PVDF), and the like. These fluorine-containing resin materials can be used singly or in combination of two or more species.

In this embodiment, the PFA tube obtained by the extrusion molding was used. A thickness of the rube was 40 μm. An inner diameter of the tube was smaller than an outer diameter of the elastic layer 22, and was 52.2 mm. An inner surface of the rube has been subjected to the ammonia treatment in order to improve the adhesive property.

(3-6) Fluorine-Containing Resin Tube Coating Method

Figure 1:
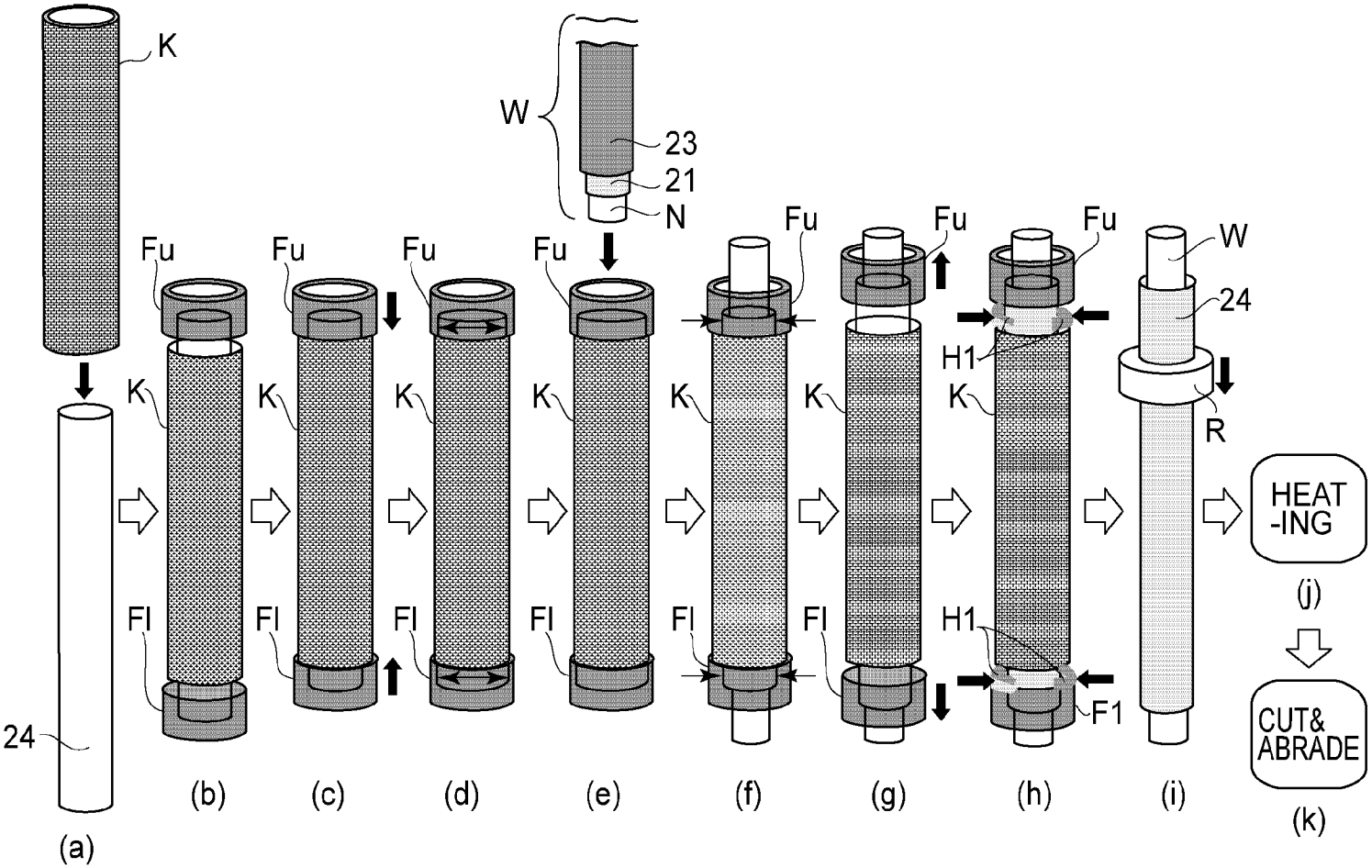

In this embodiment, a method in which the PFA tube 24 as the surface layer is expanded and the adhesive layers 23 is coated with the PFA tube 24 (expansion coating method in a fluorine-containing resin tube coating step in which the cylindrical elastic layer 22 coated with the adhesive 23 is coated with the fluorine-containing resin tube 24) was used. The expansion coating method will be described with reference to FIG. 1.

(a) Tube Insertion

The PFA tube 24 is disposed inside (inserted into) a metal-made tube expansion mold K having an inner diameter larger than an outer diameter of a base material W ((b) of FIG. 2) including the silicone rubber layer as the elastic layer 22.

(b) Holding at End Portions

The PFA tube 24 inserted into the expansion mold K is held (gripped) by holding members (holding tools or gripping tools) Fu and Fl in a longitudinal end side and the other longitudinal end side.

(c) Shortening

Next, although the PFA tube 24 will be specifically described later, the PFA tube is shortened (flexed) by a predetermined length obtained in advance with respect to a longitudinal direction. That is, this step is a step of decreasing a distance, between the holding members Fu and Fl in a PFA holding state, by a predetermined amount. Specifically, in this step, the two holding members Fu and Fl are moved toward each other in an arrow direction in (c) of FIG. 1 by a driving mechanism so that a longitudinal length of the fluorine-containing resin tube is shorter than a full length (in a natural state). Incidentally, at this time, of the holding members Fu and Fl, at least one holding member may only be required to be moved.

(d) Vacuum Elongation

The PFA tube is elongated in a radial direction thereof by an elongating mechanism.

Specifically, a portion of a gap (spacing) between the outer surface of the PFA tube 24 and the inner surface of the expansion mold K is placed in a vacuum state (state of negative pressure relative to ambient pressure may only be required) by the elongating mechanism. In the vacuum state (5 kPa), the PFA tube 24 is expanded in the radial direction, so that the outer surface of the PFA tube 24 follows and intimately contacts the inner surface of the expansion mold K.

(e) Insertion of Base Material W

On a core N, the base material W (25, 21, 26, 22, 23) is set (externally fitted), and then the resultant structure is inserted into the expansion mold K inside which the PFA tube 24 is expanded. The surface of the silicone rubber layer 22 is uniformly applied (coated) with the addition curing type silicone rubber adhesive 23 in advance.

The inner diameter of the expansion mold K is not limited particularly when the inner diameter is in a range in which the insertion of the base material W is smoothly performed.

(f) Vacuum Elimination

After the base material W is disposed in the expansion mold K, the vacuum state (state of the negative pressure relative to the ambient pressure) in which the gap portion between the outer surface of the PFA tube 24 and the inner surface of the expansion mold K is eliminated (removed). By eliminating the vacuum state, the increased diameter of the PFA tube 24 is decreased to a diameter which is the same as the outer diameter of the base material W including the silicone rubber layer 23 (a loosening step of loosening the expansion of PFA tube), so that the PFA tube 24 and the silicone rubber layer are placed in a state in which the surfaces thereof are intimately contacted to each other. (g) Elongating step Next, the PFA tube 24 is elongated to a predetermined elongation (percentage) (fluorine-containing resin tube elongation step in longitudinal direction). That is, this step is a step of increasing a distance, between the holding members Fu and Fl in the PFA tube holding state, by a predetermined amount. Specifically, in this step, the holding members Fu and Fl in the PFA tube holding state are moved away from each other by the above-described driving mechanism. Incidentally, in this step, of the holding members Fu and Fl, at least one holding member may only be required to be moved.

When the PFA tube 24 is elongated, the addition curing type silicone rubber adhesive 23 disposed between the PFA resin tube 24 and the silicone rubber layer 22 performs the function of a lubricant, so that the PFA tube 24 can be smoothly elongated.

(h) Calking step

In order to maintain the longitudinal elongation (tension) of the PFA tube 24, in this step, longitudinal end portions (to be cut in a later step) of the elastic layer 22 and the PFA tube 24 are caulked by a heating mechanism such as a caulking bit H1 in which a heater is incorporated.

(i) Squeezing Step

Between the elastic layer 22 and the PFA tube 24, the excessive addition curing type silicone rubber adhesive 23 which does not contribute to the bonding and the air taken (included) during the tube coating are present. This step is a step of squeezing (removing) the excessive adhesive and the air may preferably be performed.

The base material W coated with the PFA tube 24 is taken out from the expansion mold K. A ring(-like) member R as a squeezing mechanism having an inner diameter slightly larger than an outer diameter of the base material W is externally fitted around the PFA tube 24 with which the base material W is coated. Then, the ring member R is slid from an upper end portion to a lower end portion of the PFA tube with which the base material W is coated. The ring member R is provided with many air nozzle holes at an inner peripheral surface thereof, and at this time, the air is jetted (at air pressure of 0.5 MPa) from these nozzle holes toward the surface of the PFA tube 24. The air jetting is made with respect to a radial direction directed toward the center of the PFA tube 24. That is, the ring member R is moved in the longitudinal direction while jetting the air.

As a result, the excessive addition curing type silicone rubber adhesive 23, which does not contribute to the bonding, and the air taken during the tube coating which are present between the elastic layer 22 and the PFA tube 24 are squeezed out (removed) (step of squeezing the coated adhesive).

As the squeezing method, other than the method using the air pressure, a liquid or semi-solid may also be jetted. Further, the squeezing may also be made by using an expanding and contracting ring having a diameter smaller than the outer diameter of the base material W coated with the PFA tube 24.

(j) Heating (Treatment)

After the squeezing step, by effecting heating (at 150° C. for 20 minutes in the electric furnace as the heating mechanism), the addition curing type silicone rubber adhesive 23 is cured as a whole. As a result, the PFA tube 24 and the elastic layer 22 are fixed over the entire region via the cured adhesive 23 (adhesive curing step).

(k) Cut and Abrasion

After the heating, the base material W (25, 21, 26, 22, 23, 24) is cut by a cutting mechanism at end portions thereof so that the fixing belt has a predetermined length. Therefore, a cut surface is abraded by an abrading mechanism.

By such a series of manufacturing steps, a manufacturing process of the fixing belt 20 is completed.

Incidentally, in this embodiment, the longitudinal elongation of the PFA tube was 7% (on the basis of a full length (natural length) of the fluorine-containing resin tube with which the cylindrical is coated). By elongating the PFA tube in the longitudinal direction, the creases are not readily generated on the PFA tube, so that the fixing belt with high durability is provided.

Before the step (d) in which the gap portion between the outer surface of the PFA tube 24 and the inner surface of the elongation mold K is placed in the vacuum state (negative pressure relative to the ambient pressure), the loosing step (c) in which the longitudinal length of the PFA tube 24 is shortened is provided. This is because by an experiment by the present inventors, it is confirmed that the PFA tube contracts in the longitudinal direction when the PFA tube is expanded in the radial direction. When the PFA tube 24 is expanded in the radial direction in a state in which the PFA tube 24 is fixed at the longitudinal end portions thereof, a force by which the PFA tube 24 contracts in the longitudinal direction and a force by which the PFA tube 24 is expanded in the radial direction are exerted on the PFA tube 24, and therefore the PFA tube 24 is liable to cause plastic deformation. Therefore, when the PFA tube 24 is expanded in the radial direction, it is preferable that the plastic deformation is not readily caused by loosening the PFA tube 24 in the longitudinal direction in advance.

(3-7) Measurement of Longitudinal Shortening (Contracting) Amount when Fluorine-Containing Resin Tube is Increased in Diameter Measurement of the longitudinal shortening (contracting) amount of the PFA tube 24 when the PFA tube 24 is expanded (increased in diameter) in the radial direction is made by coating a cylinder or the like, having the same outer diameter as the inner diameter of the tube expansion mold K, with the PFA tube 24 in a good lubrication state and then by measuring the longitudinal shortening amount.

The PFA tube 24 has a range of individual diameter size to some extent due to manufacturing variation. The diameter size of the PFA tube 24 allows variation of about 1.3 mm with respect to the standard. Therefore, the longitudinal shortening amount may preferably be measured every manufacturing lot.

Alternatively, it would be considered that the longitudinal shortening amount is calculated from a coefficient with respect to a diameter change rate and a longitudinal change rate of the PFA tube 24. In the following, a method for obtaining the longitudinal shortening amount from the coefficient with respect to the diameter change rate and the longitudinal change rate will be described.

1) A diameter of the PFA tube 24 to be coated is taken as A.

2) An inner diameter of a cylinder with which the PFA tube 24 is generated is taken as B.

3) The diameter change rate when the PFA tube 24 is expanded in the radial direction is represented by (B−A)/A×100(%).

4) The PFA tube 24 is marked at each of longitudinal ends thereof. A spacing between the marks is taken as Cn. A cylinder or the like having a known diameter is coated with the PFA tube 24 in a god lubrication state, and then the spacing between the marks after the coating with the PFA tube 24 is measured. The spacing after the coating is taken as Dn. A longitudinal change rate E is represented by E=(Dn−Cn)/Cn×100(%).

5) A plurality of cylinders or the like having an outer diameters (which may preferably have diameter change rates of 5% to 15%) are used to obtain a longitudinal change rate En. The longitudinal change rate En is taken as Y, and a diameter change rate n is taken as X, and then a slope of regression line is obtained. This slope is a coefficient F which represents a relationship between the radial direction and the longitudinal direction of the PFA tube 24. In this embodiment, the coefficient F=−0.60.

By using the coefficient F, the longitudinal shortening amount of other PFA tube 24 when the PFA tube 24 is intimately contacted to the metal-mode tube expansion mold K is calculated. The diameter A of the PFA tube 24 is 51.6 mm. The inner diameter of the metal-mode tube expansion mold K is 57.2 mm.

Therefore, the diameter change rate is:

$$(B-A)/A\times 100 = (57.2-51.6)/51.6\times 100 = 0.109(10.9\%).$$

The coefficient F which represents the relationship between the radial direction and the longitudinal direction of the PFA tube 24 is −0.60, and therefore the longitudinal change rate when the PFA tube is changed in the radial direction by 10.9% is represented by:

$$(\text{diameter change rate})\times(\text{coefficient } F) = 10.9\%(0.109)\times -0.60 = -0.065(-6.5\%).$$

The length of the PFA tube 24 is 420 mm.

Therefore the longitudinal shortening amount of the PFA tube 24 when the PFA tube 24 is intimately contacted to the inner surface of the metal-made tube expansion mold K is:

$$420\text{ mm}\times -6.5\% = 420\text{ mm}\times(-6.5/100) = -27.3\text{ mm}.$$

With aspect to the coefficient with respect to the diameter change rate and the longitudinal change rate of the PFA tube 24, in the case where the thickness, the material and the manufacturing process of the PFA tube 24 are the same (are not changed), even when the diameter size of the PFA tube 24 is different by about 5 mm, the coefficient with respect to diameter change rate and the longitudinal change was the same values (was not changed). Therefore, the diameter size of the PFA tube 24 has the manufacturing deviation, but the efficient with respect to the diameter change rate and the longitudinal change rate is used, so that the longitudinal shortening amount can be calculated by measuring the diameter of the PFA tube every manufacturing lot and then only by applying the measured diameter to the above calculating formula.

As described above, the longitudinal shortening amount can be obtained by the actual measurement or the calculation before the PFA tube 24 is expanded in the radial direction. However, the resultant value contains an experimental error, and therefore the longitudinal shortening amount may preferably be made smaller than the above-obtained value.

This is because when the longitudinal shortening amount is excessively large, the diameter is expanded in a longitudinally loosened state, and therefore the PFA tube 24 generates creased with respect to a circumferential direction.

Therefore, in this embodiment, the longitudinal shortening amount of the PFA tube 24 was set at 12.5 mm in each of the longitudinal end sides (i.e., each of the holding members Fu and Fl was moved inside by 12.5 mm), and thus was set at 25.0 mm in total in both of the longitudinal end sides.

(4) Fluorine-Containing Resin Tube Coating Method in Comparison Example

In Comparison example, before the PFA tube 24 is increased in diameter in the vacuum state (negative pressure relative to the ambient pressure) of the gap portion between the outer surface of the PFA tube 24 and the inner surface of the expansion mold K, the step of shortening the length of the PFA tube 24 with respect to the longitudinal direction is not provided.

Figure 6:
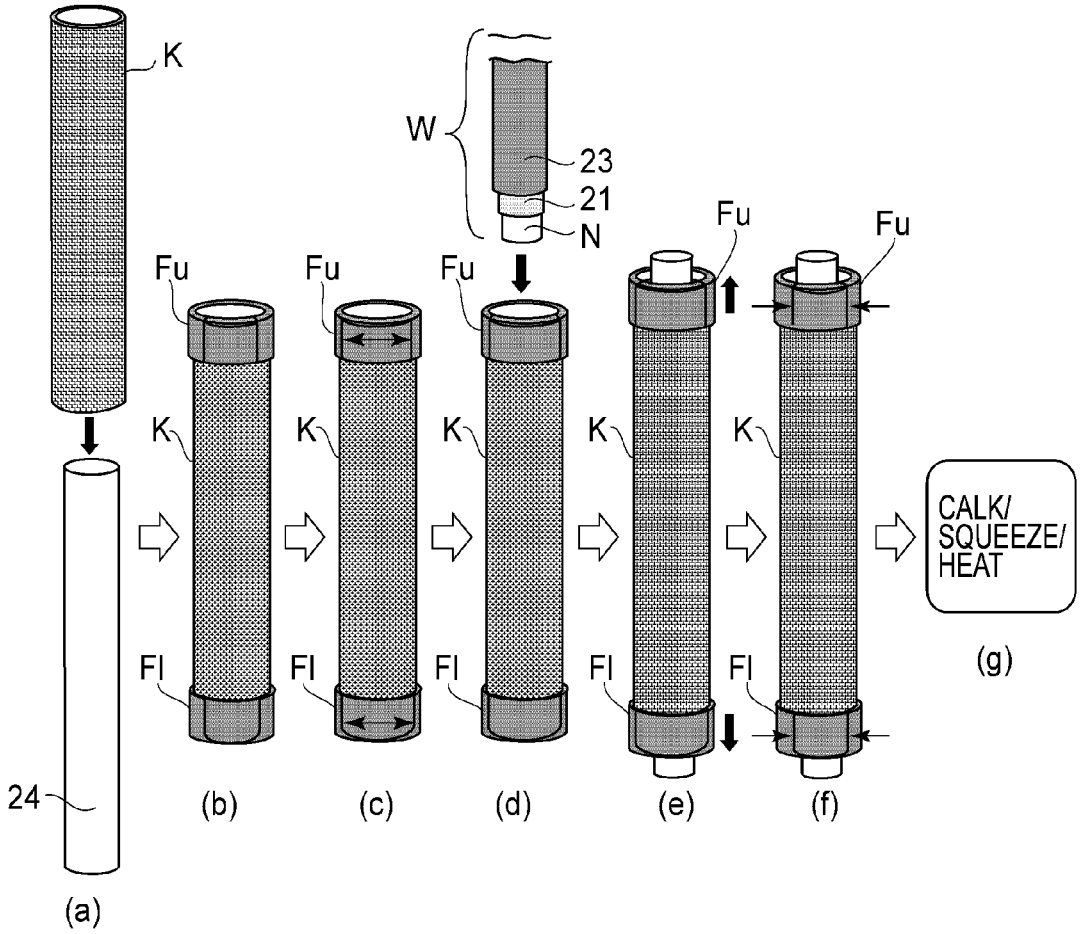
FIG. 6 is a schematic view for illustrating a PFA tube coating method in Comparison example to Embodiment 1.

Further, a fluorine-containing resin tube coating method in which the vacuum state (negative pressure relative to the ambient pressure) of the gap portion between the outer surface of the PFA tube 24 and the inner surface of the expansion mold K is not eliminated before the PFA tube 24 is elongated in the longitudinal direction will be described with reference to FIG. 6.

(a) The PFA tube 24 is disposed inside the metal-mode tube expansion mold K having the inner diameter larger than the outer diameter of the base material W including the silicone rubber layer as the elastic layer 22.

(b) The PFA tube 24 is held by the holding members Fu and Fl at the longitudinal ends thereof.

(c) The gap portion between the outer surface of the PFA tube 24 and the inner surface of the expansion mold K is placed in the vacuum state (negative pressure relative to the ambient pressure). In the vacuum state (5 kPa), the PFA tube 24 is expanded, so that the outer surface of the PFA tube 24 is intimately contacted to the inner surface of the expansion mold K.

(d) Here, the base material W including the silicone rubber layer is inserted into the PFA tube 24. The surface of the silicone rubber layer is uniformly coated with the addition curing type silicone rubber adhesive 23 in advance.

(e) After the base material W including the silicone rubber layer is disposed inside the expanded PFA tube 24, the PFA tube 24 is elongated to a predetermined elongation (percentage).

(f) Then, the vacuum state (negative pressure relative to the ambient pressure) of the gap portion between the outer surface of the PFA tube 24 and the inner surface of the expansion mold K is eliminated. By eliminating the vacuum state, the increased diameter of the PFA tube 24 is decreased to the same diameter as the outer diameter of the base material W including the silicone rubber layer, so that the PFA tube 24 and the surface of the base material W are placed in an intimate contact state.

(g) Thereafter, similarly as in the steps (h) to (k) in Embodiment 1, in order to maintain the elongation, the PFA tube 24 and the base material W (the elastic layer 22) are calked at the end portions (to be cut in a later step). Thereafter, the excessive adhesive 23, which does not contribute to the adhesive bonding, and the air taken (included) during the coating are squeezed, and then is heated (at 150° C. for 20 minutes in the electric furnace), so that the PFA tube 24 and the elastic layer 22 are fixed (via the adhesive 23). The longitudinal elongation in Comparison example was 7% (on the basis of the full length of the fluorine-containing resin tube with which the cylindrical elastic layer is coated) which was the same as that in Embodiment 1. After the PFA tube 24 was naturally cooled and then the PFA tube 24 was cut and then abraded at the end portions thereof, so that the preparation of the fixing belt 20 was completed.

(5) Outer Appearance Check Result of Fixing Belt 20

By using PFA tubes different in diameter size, fixing belts 20 were manufactured by the fluorine-containing resin tube coating methods in this embodiment and Comparison example, and then outer appearance of each of the fixing belts 20 was checked.

The PFA tubes 24 having the different diameter sizes were of three types including a minimum specification (standard) product, an out-of-specification product of −1 mm (smaller in diameter than the minimum specification product by 1 mm) and an out-of-specification product of −2 mm (smaller in diameter than the minimum specification product by 2 mm).

The outer appearance check was made by boundary sample comparison using monochromatic light to discriminate elongation and tearing of the PFA tube 24 in terms of a defective product rate (%). The defective product rate (%) as a result of the check is shown in Table 1.

TABLE 1

| EMB. | IDS*1 | DRR*2 |
|---|---|---|
| EMB. 1 | −2 mm | 16% |
| | −1 mm | 0% |
| | MIN. | 0% |
| COMP. EX. | −2 mm | 95% |
| | −1 mm | 17% |
| | MIN. | 0% |

*1"IDS" represents the inner diameter size. "−2 mm" shows that the PFA tube 24 is the cut-of-specification product of −2 mm. "−1 mm" shows that the PFA tube 24 is the out-of-specification product of −1 mm. "MIN." shows that the PFA tube 24 is the minimum specification product.
*2"DRR" represents the defective product rate (%).

With respect to the fixing belt 20 prepared by the fluorine-containing resin tube coating method in Embodiment 1, even when the PFA tube 24 having the diameter smaller than the minimum specification product by 1 mm was used, it was able to be checked that the PFA tube 24 did not generate the elongation and the tearing. In the case where the PFA tube 24 having the diameter smaller than the minimum specification product by 2 mm was used, the defective product was generated at the defective product rate of 16%.

With respect to the fixing belt 20 prepared by the fluorine-containing resin tube coating method in Comparison example, in the case where the PFA tube 24 having the diameter smaller than the minimum specification product by 1 mm was used, the defective product was generated at the defective product ratio of 17%. In the case where the PFA tube 24 having the diameter smaller than the minimum specification product by 2 mm was used, the defective product was generated at the defective product rate of 95%.

From the above results, it was found that this embodiment (Embodiment 1) was capable of reducing the defective product rate compared with Comparison example.

(6) Durability Test Result

In a durability test, as the fixing belt of the fixing device used in the image forming apparatus, a good (non-defective) product of the fixing belt 20 prepared by the fluorine-containing resin tube coating method in this embodiment and the fixing belt 20 prepared by the fluorine-containing resin tube coating method in Comparison example using the minimum specification product of the PFA tube 24 were used.

As the recording material, high-quality color laser copier sheets having a basis weight of 80 g/m$^2$ (available from Canon Kabushiki Kaisha) were used. The sheet size is A4 size, and the sheets was continuously introduced into the nip (70 sheets/minute) in parallel to a widthwise (short) direction thereof. Further, a sheet of coated paper ("OK Top Coat", basis weight: 128 g/m$^2$, manufactured by Oji Paper Co., Ltd.) was inserted every 100,000 sheets. On the coated paper, a uniform half-tone image of cyan is formed. The sheet size of the coated paper was 13 (inch)×19 (inch).

Whether or not there was image defect such as damage, streaks or uneven glossiness was checked. In the case where there was not image defect, evaluation was "○". In the case where the image defect was observed, evaluation was "x". In the case where the image defect was observed but was at a level of practically no problem, evaluation was "Δ". A test result shown in Table 2.

TABLE 2

| | | Print number (sheets) | | | | | |
|---|---|---|---|---|---|---|---|
| EMB. | IDS*1 | 100k | 200k | 300k | 400k | 500k | 600k |
| EMB. 1 | −2 mm | ○ | ○ | ○ | ○ | ○ | ○ |
| | −1 mm | ○ | ○ | ○ | ○ | ○ | ○ |
| | MIN. | ○ | ○ | ○ | ○ | ○ | Δ |
| COMP. EX. | MIN. | ○ | ○ | ○ | ○ | ○ | Δ |

*1"IDS" represents the inner diameter size. "−2 mm" shows that the PFA tube 24 is the cut-of-specification product of −2 mm. "−1 mm" shows that the PFA tube 24 is the out-of-specification product of −1 mm. "MIN." shows that the PFA tube 24 is the minimum specification product.

The fixing belt 20 prepared by the fluorine-containing resin tube coating method of Embodiment 1 using the minimum specification product (having the minimum specification inner diameter) as the PFA tube 24 somewhat generated the uneven glossiness at 600,000 (600 k) sheets but the uneven glossiness was at a level of practically no problem. Also the fixing belt 20 prepared by the fluorine-containing resin tube coating method of Comparison example using the minimum specification product (having the same size (minimum specification inner diameter)) as the PFA tube 24 somewhat generated the uneven glossiness at 600,000 (600 k) sheets but the uneven glossiness was at a level of practically no problem.

From the above results, it was found that the fixing belt 20 prepared by the fluorine-containing resin tube in this embodiment (Embodiment 1) had a good fixing property.

Embodiment 1

Embodiment 1 will be described. Constituent elements (members) identical in constitution to those in Embodiment 1 are represented by the same reference numerals or symbols as those in Embodiment 1 and will be omitted from detailed description. In this embodiment, the fixing belt manufacturing method in Embodiment 1 is applied to a pressing belt manufacturing method.

(1) Pressing Belt 30

In this embodiment, with respect to also a layer structure of the pressing belt 30, as the other fixing member, opposing the fixing belt 20, the same layer structure as that of the fixing belt 20 was employed. That is, similarly as in the layer structure of the fixing belt 20 shown in FIG. 2. The layer structure of the pressing belt 30 includes the base material 21, the elastic layer 22, the adhesive layer 23, the fluorine-containing resin tube 24 and the like. However, each of the base material 21, the elastic layer 22 and the fluorine-containing resin tube 24 is changed to a layer formed of an optimum material or member as that for the pressing belt 30.

(1-1) Base Material 21

As the base material 21 for the pressing belt 30, in this embodiment, an electroformed nickel belt of 55 mm in inner diameter and 50 μm in thickness is used. Similarly as in the fixing belt 20, the thickness of the base material 21 may preferably be 1-300 μm. When the thickness of the base material 21 is smaller than 1 μm, rigidity is low, and therefore it becomes difficult to withstand a durability test of a large number of sheets. Further, when the thickness of the base material 21 exceeds 300 μm, the rigidity becomes excessively high, and flexing resistance is lowered, so that use of the resultant belt as the rotatable belt member is not practical.

(1-2) Elastic Layer 22 and Manufacturing Method of Elastic Layer 22

Over the outer peripheral surface of the base material 21, the elastic layer 22 is provided via the primer layer 26. As a material for the elastic layer 22, a known elastic material can be used. For example, silicone rubber, fluorine-containing rubber and the like can be used. In this embodiment, silicone rubber is used as the material for the elastic layer 22, and the elastic layer 22 is 21 degrees in JIS-A hardness, 0.4 W/mk in thermal conductivity and 300 μm in thickness. As a coating method, similarly as in Embodiment 1, the so-called ring coating (method) was used.

In this embodiment, differences from Embodiment 1 in the step of forming the silicone rubber longitudinal 22 are as follows. That is, the differences are only the addition curing type silicone rubber composition, in which the addition curing type silicone rubber and the filler are mixed, charged into the cylinder pump 41 (FIG. 5), and a speed of movement of the base material 21 to be moved in the right direction in FIG. 5 at the certain speed simultaneously with the application (coating).

(1-3) Adhesive Layer 23

The adhesive layer 23 in this embodiment is the same as that in Embodiment 1.

(1-4) Fluorine-Containing Resin Tube 24

In this embodiment, the PFA tube 24 obtained by the extrusion molding was used. A thickness of the rube was 30 μm. An inner diameter of the tube was smaller than an outer diameter of the elastic layer 22, and was 53.0 mm. An inner surface of the rube has been subjected to the ammonia treatment in order to improve the adhesive property. Further, the PFA tube 24 used in this embodiment was of a heat contraction type (in which the full length contracted by 6% when the PFA tube 24 was heated at 150° C. for 20 minutes).

(1-5) Fluorine-Containing Resin Tube Coating Method in This Embodiment

A method in which the PFA tube is expanded and the adhesive layer is coated with the PFA tube (expansion coating method was used. The expansion coating method will be described with reference to FIG. 7. Steps (a) to (f) are the same as the steps (a) to (f) in FIG. 1 in Embodiment 1.

In this embodiment, the PFA tube 24 is disposed inside a metal-made tube expansion mold K having an inner diameter of 57.2 mm, and then is held by using holding members Fu and Fl in longitudinal end sides.

Next, although details will be described later, the PFA tube is shortened by 18.0 mm obtained in advance with respect to a direction. That is, similarly as in Embodiment 1, a distance between the holding members Fu and Fl in a PFA holding state decreased (shortened) by a predetermined amount. Specifically, the holding members Fu and Fl in the PFA time tube holding state are moved toward each other.

Thereafter, the gap portion between the outer surface of the PFA tube 24 and the inner surface of the expansion mold K is placed in the vacuum state (negative pressure relative to the ambient pressure). In the vacuum state (5 kPa), the PFA tube 24 is expanded, so that the outer surface of the PFA tube 24 is intimately contacted to the inner surface of the expansion mold K.

Here, the base material W including the silicone rubber layer is inserted into the PFA tube 24. The surface of the silicone rubber layer is uniformly coated with the addition curing type silicone rubber adhesive 23 in advance. After the base material W including the silicone rubber layer is disposed inside the expanded PFA tube 24, the vacuum state (negative pressure relative to the ambient pressure) of the gap portion between the outer surface of the PFA tube 24 and the inner surface of the expansion mold K is eliminated.

By eliminating the vacuum state, the increased diameter of the PFA tube 24 is decreased to the same diameter as the outer diameter of the base material W including the silicone rubber layer, so that the PFA tube 24 and the surface of the base material W are placed in an intimate contact state.

Thereafter, subsequent steps are the same as the steps (h) to (k) in Embodiment 1. That is, the PFA tube 24 and the base material W (the elastic layer 22) are calked at the end portions (to be cut in a later step). Thereafter, the excessive adhesive 23, which does not contribute to the adhesive bonding, and the air taken (included) during the coating are squeezed, and then is heated (at 150° C. for 20 minutes in the electric furnace as the heating mechanism), so that the PFA tube 24 and the elastic layer 22 are fixed (via the adhesive 23). After the PFA tube 24 was naturally cooled and then the PFA tube 24 was cut and then abraded at the end portions thereof, so that the preparation of the fixing belt 20 was completed.

(1-6) Measurement of Shortening (Contracting) Amount During Expansion of Fluorine-Containing Resin Tube.

Similarly as in Embodiment 1, the longitudinal shortening amount of the PFA tube 24 was obtained from the coefficient with respect to the diameter change rate and the longitudinal change rate.

1) The diameter A of the PFA tube 24 to be coated is 53.0 mm.

2) The inner diameter B of the metal-made tube expansion mold K is 57.2 mm.

3) The diameter change rate of the PFA tube 24 is represented by:

$$(B-A)/A\times 10\ 0(5)=(57.2-53.0)/53.0\times 100$$
$$=0.0.79(7.9\%).$$

The coefficient F which is a coefficient with respect to the diameter change rate and the longitudinal change rate of the PFA tube 24 was −0.58. By using the coefficient F which is the coefficient with respect to the diameter change rate and the longitudinal change rate of the PFA tube 24, the longitudinal shortening amount of the PFA tube 24 when the PFA tube 24 is intimately the longitudinal change rate when the PFA tube 24 is changed in the radial direction by 7.9% is represented by:

$$(\text{diameter change rate})\times(\text{coefficient } F)=7.9\%(0.079)\times -0.58$$
$$=-0.046(-4.6\%).$$

The length of the PFA tube 24 is 420 mm. Therefore the longitudinal shortening amount of the PFA tube 24 when the PFA tube 24 is intimately contacted to the inner surface of the metal-made tube expansion mold K is:

$$420\ \text{mm}\times -4.6\%=420\ \text{mm}\times(-4.6/100)$$
$$=-19.3\ \text{mm}.$$

In consideration of an experimental error in this embodiment, the longitudinal shortening amount of the PFA tube 24 was set at 9.0 mm in each of the longitudinal end sides (i.e., each of the holding members Fu and Fl was moved inside by 9.0 mm), and thus was set at 18.0 mm in total in both of the longitudinal end sides.

(2) Fluorine-Containing Resin Tube Coating Method in Comparison Example

As Comparison example, before the vacuum state (negative pressure relative to the ambient pressure) of the gap portion between the outer surface of the PFA tube 24 and the inner surface of the expansion mold K was created in the expansion coating method, the pressing belt 30 was completed by a method in which the step of shortening the length of the PFA tube 24 with respect to the longitudinal direction was not provided.

Figure 7:
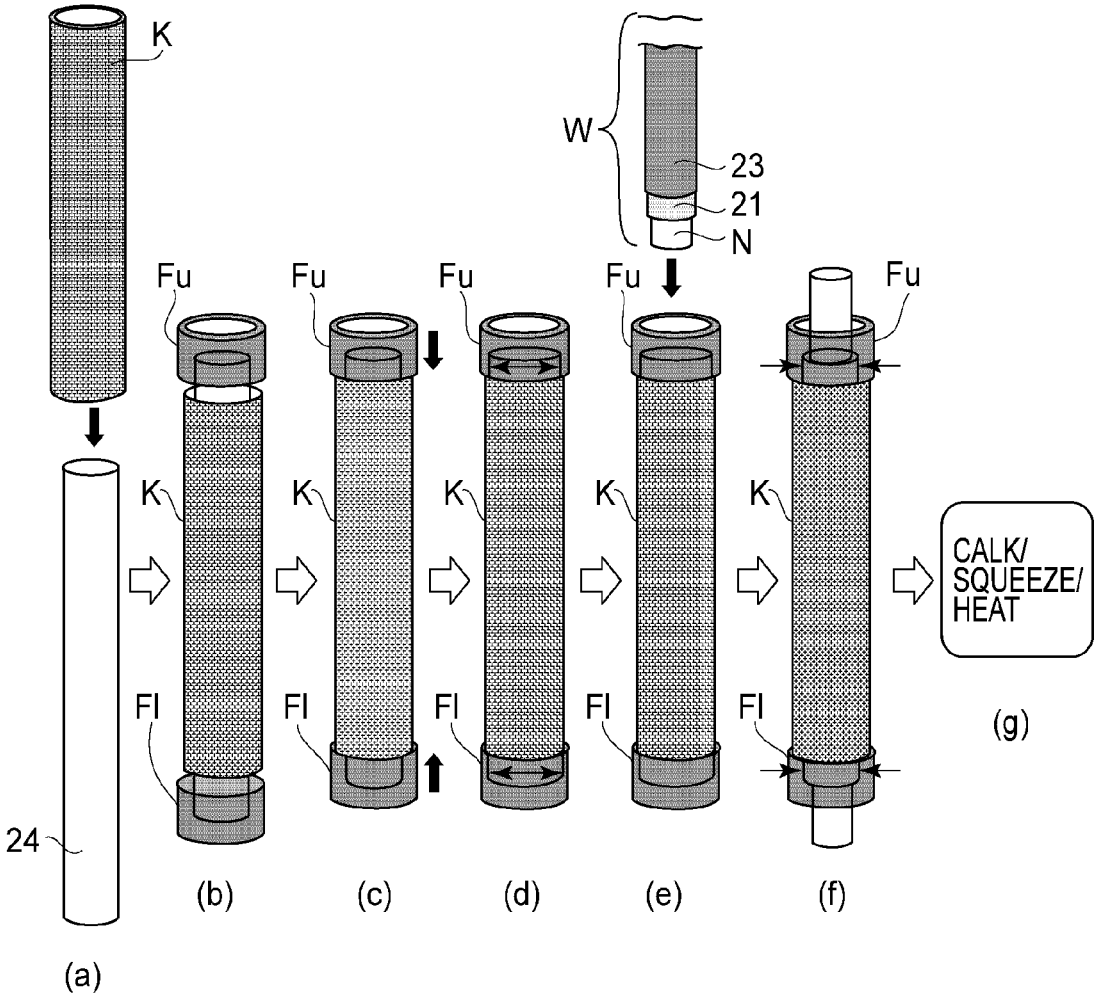
FIG. 7 is a schematic view for illustrating a PFA tube coating method in Embodiment 2.
Figure 8:
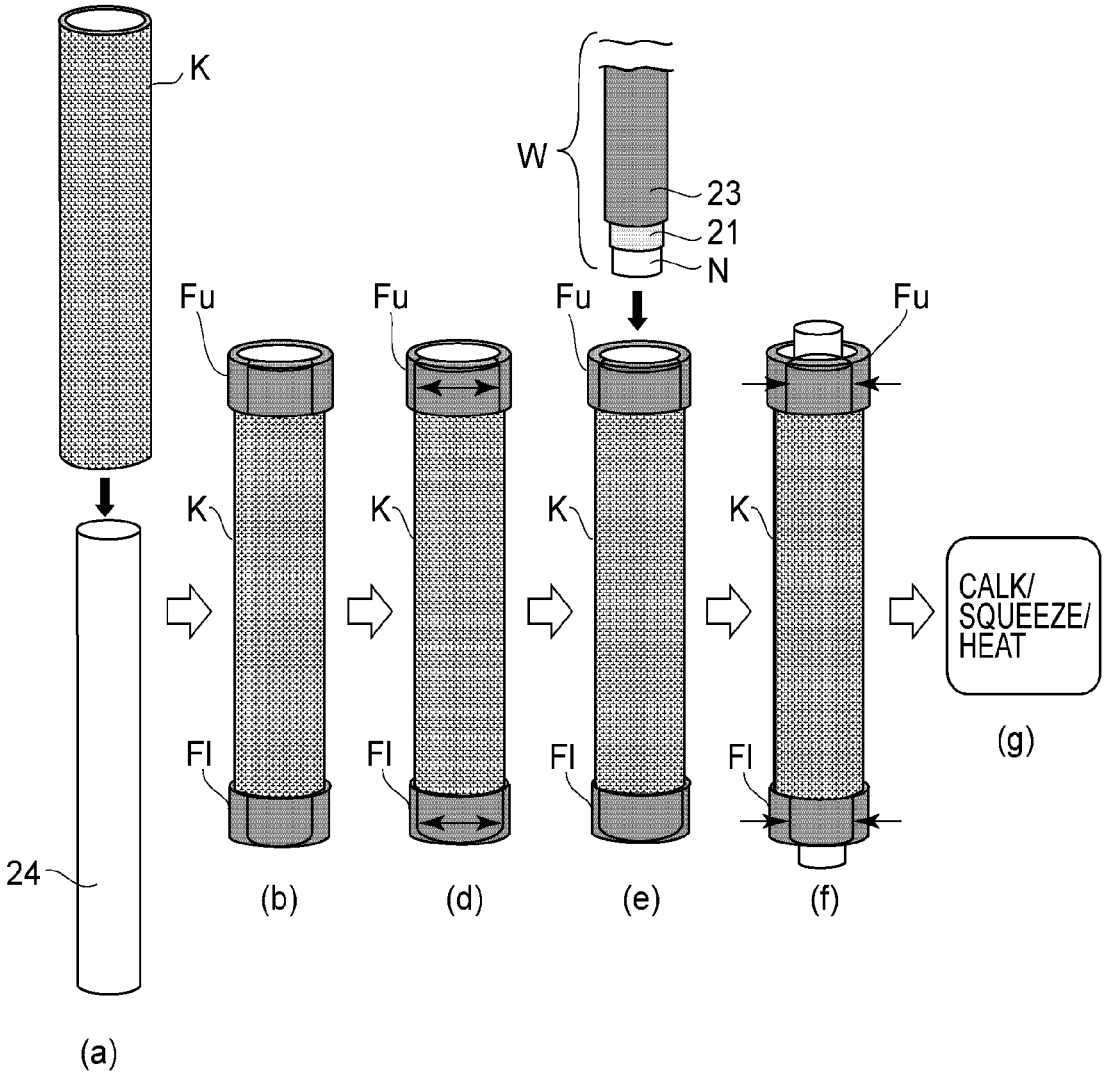
FIG. 8 is a schematic view for illustrating a PFA tube coating method in Comparison example 2 to Embodiment 2.

That is, the pressing belt 30 in Comparison example was completed in the procedure of FIG. 8 in which the shortening step (c) in FIG. 7 is omitted and in which other steps (a), (b) and (d) of (g) are the same as those in FIG. 7.

More specifically, the PFA tube 24 is disposed inside the metal-mode tube expansion mold K having the inner diameter 0f 57.2 mm and then is held by the holding members Fu and Fl at the longitudinal ends thereof. The gap portion between the outer surface of the PFA tube 24 and the inner surface of the expansion mold K is placed in the vacuum state (negative pressure relative to the ambient pressure). In the vacuum state (5 kPa), the PFA tube 24 is expanded, so that the outer surface of the PFA tube 24 is intimately contacted to the inner surface of the expansion mold K.

Here, the base material W including the silicone rubber layer is inserted into the PFA tube 24. The surface of the silicone rubber layer is uniformly coated with the addition curing type silicone rubber adhesive 23 in advance. After the base material W including the silicone rubber layer is disposed inside the expanded PFA tube 24, the vacuum state (negative pressure relative to the ambient pressure) of the gap portion between the outer surface of the PFA tube 24 and the inner surface of the expansion mold K is eliminated. By eliminating the vacuum state, the increased diameter of the PFA tube 24 is decreased to the same diameter as the outer diameter of the base material W including the silicone rubber layer, so that the PFA tube 24 and the surface of the base material W are placed in an intimate contact state.

Then, after the excessive adhesive 23, which does not contribute to the adhesive bonding, and the air taken (included) during the coating are squeezed, the PFA tube 24 is heated (at 150° C. for 20 minutes in the electric furnace), so that the PFA tube 24 and the elastic layer 22 are fixed (via the adhesive 23). After the PFA tube 24 was naturally cooled and then the PFA tube 24 was cut and then abraded at the end portions thereof, so that the preparation of the fixing belt 20 was completed.

(3) Outer Appearance Check Result of Pressing Belt 30

By using PFA tubes different in diameter size, pressing belts 30 were manufactured by the fluorine-containing resin tube coating methods in this embodiment and Comparison example, and then outer appearance of each of the pressing belts 30 was checked.

The PFA tubes 24 having the different diameter sizes were of three types including a minimum specification (standard) product, an out-of-specification product of −2 mm (smaller in diameter than the minimum specification product by 2 mm) and an out-of-specification product of −3 mm (smaller in diameter than the minimum specification product by 3 mm).

The outer appearance check was made by boundary sample comparison using monochromatic light to discriminate elongation and tearing of the PFA tube 24 in terms of a defective product rate (%). The defective product rate (%) as a result of the check is shown in Table 3.

TABLE 3

| EMB. | IDS*[1] | DRR*[2] |
|---|---|---|
| EMB. 2 | −3 mm | 15% |
| | −2 mm | 0% |
| | MIN. | 0% |
| COMP. EX. | −3 mm | 85% |
| | −2 mm | 13% |
| | MIN. | 0% |

*[1]"IDS" represents the inner diameter size. "−3 mm" shows that the PFA tube 24 is the cut-of-specification product of −3 mm. "−2 mm" shows that the PFA tube 24 is the out-of-specification product of −2 mm. "MIN." shows that the PFA tube 24 is the minimum specification product.
*[2]"DRR" represents the defective product rate (%).

With respect to the pressing belt 30 prepared by the fluorine-containing resin tube coating method in Embodiment 2, even when the PFA tube 24 having the diameter smaller than the minimum specification product by 2 mm was used, it was able to be checked that the PFA tube 24 did not generate the elongation and the tearing. In the case where the PFA tube 24 having the diameter smaller than the minimum specification product by 3 mm was used, the defective product was generated at the defective product rate of 15%.

With respect to the pressing belt 30 prepared by the fluorine-containing resin tube coating method in Comparison example, in the case where the PFA tube 24 having the diameter smaller than the minimum specification product by 2 mm was used, the defective product was generated at the defective product ratio of 13%. In the case where the PFA tube 24 having the diameter smaller than the minimum specification product by 3 mm was used, the defective product was generated at the defective product rate of 85%.

From the above results, it was found that this embodiment (Embodiment 2) was, similarly as in Embodiment 1, capable of reducing the defective product rate compared with Comparison example.

Other Embodiments (1) In Embodiments 1 and 2, with respect to both of the fixing belt and the pressing belt as the fixing member, the endless belt member was described, but the fixing member is not limited thereto. As the fixing member, a roller-shaped member including a roller-shaped or hollow roller-shaped base substrate 21 having rigidity, the cylindrical elastic layer 22 formed over the outer peripheral surface of the base substrate, and the fluorine-containing resin tube 24 coating over the surface of the elastic layer 22 may also be used.

(2) In the fixing device A, other than the device for fixing or temporarily fixing the unfixed toner image (visualized image or developer image) as a fixed image by heating the unfixed toner image by using the fixing member, also a device for modifying a surface property such as gloss by re-heating the fixed toner image is included.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 237943/2012 filed Oct. 29, 2012, which is hereby incorporated by reference.

What is claimed is:

1. A fixing member manufacturing method comprising:

a step of holding a longitudinal end of a resin tube by a first holding tool;

a step of holding another longitudinal end of the resin tube by a second holding tool;

a step of decreasing a distance between the first and second holding tools each holding the resin tube so that a longitudinal length of the resin tube is decreased to less than its full length in a natural state;

a step of expanding the resin tube, of which the longitudinal length has been decreased to less than its full length in the natural state in the decreasing step, in a radial direction; and a step of externally fitting the resin tube, expanded in the radial direction, around an elastic material coated with an adhesive.

2. The method according to claim 1, wherein the resin tube is a fluorine containing resin tube.

3. The method according to claim 2, wherein the fluorine containing resin tube is a PFA resin tube.

4. The method according to claim 1, wherein in the decreasing step, (i) the first holding tool is moved toward the second holding tool; (ii) the second holding tool is moved toward the first holding tool; or (iii) the first and second holding tools are moved toward each other.

5. The method according to claim 1, further comprising a step of eliminating the expansion of the resin tube in the radial direction after the externally fitting step.

6. The method according to claim 5, further comprising, after the eliminating step, a step of increasing a distance between the first and second holding tools each holding the resin tube, by a predetermined amount.

7. The method according to claim 6, in the increasing step, (i) the first holding tool is moved away from the second holding tool; (ii) the second holding tool is moved away from the first holding tool; or (iii) the first and second holding tools are moved away from each other.

8. The method according to claim 6, further comprising, after the externally fitting step, a step of fixing the resin tube over the elastic material at longitudinal end portions of the resin tube by locally heating the resin tube at the longitudinal end portions.

9. The method according to claim 8, further comprising, after the fixing step, a step of squeezing the adhesive provided between the elastic material and the resin tube.

10. The method according to claim 9, further comprising, after the squeezing step, a step of heating the resin tube fixed over the elastic material.

* * * * *